United States Patent [19]

Woltman et al.

[11] 4,347,856

[45] Sep. 7, 1982

[54] METHOD AND APPARATUS FOR REMOVING CIGAR WRAPPERS FROM THE WEB OF A BOBBIN

[75] Inventors: John Woltman; Donald W. Zarfos, both of Red Lion, Pa.; Robert F. Bulger, deceased, late of York, Pa., by Mary L. Bulger, executrix

[73] Assignee: United States Tobacco Company, Greenwich, Conn.

[21] Appl. No.: 151,743

[22] Filed: May 20, 1980

[51] Int. Cl.[3] ..... A24C 1/00

[52] U.S. Cl. ..... 131/105

[58] Field of Search ..... 131/105

[56] References Cited

U.S. PATENT DOCUMENTS 4,095,606 6/1978 Frandsen ..... 131/105

FOREIGN PATENT DOCUMENTS 534957 10/1955 Belgium ..... 131/105
1251219 10/1971 United Kingdom ..... 131/105
2025752 1/1980 United Kingdom ..... 131/105

*Primary Examiner*—V. Millin
*Attorney, Agent, or Firm*—Harold L. Stults; Pasquale A. Razzano

[57] ABSTRACT

A method and apparatus for providing cigar wrappers for a cigar wrapping machine. The cigar wrappers are stored in a bobbin which is a continuous web of porous sheet material which is wound into a roll with the cigar wrappers positioned upon one surface of the roll and compressed between the adjacent surfaces of the respective layers or turns in the roll. The web is drawn from the bobbin to a transfer zone in the wrapping machine along a continuous path. The web is diverted from the path around a knife edge which forms the upstream edge of a gap between two plates. The web passes from the knife edge around a roller and then back through the gap. The cigar wrappers are peeled from the web by the sharp turn of the web around the knife edge and they pass over the narrow gap directly onto the web which is moving back through the gap from the roller. This overcomes a serious difficulty which was encountered in removing the cigar wrappers from the web.

13 Claims, 4 Drawing Figures

FIG. 1
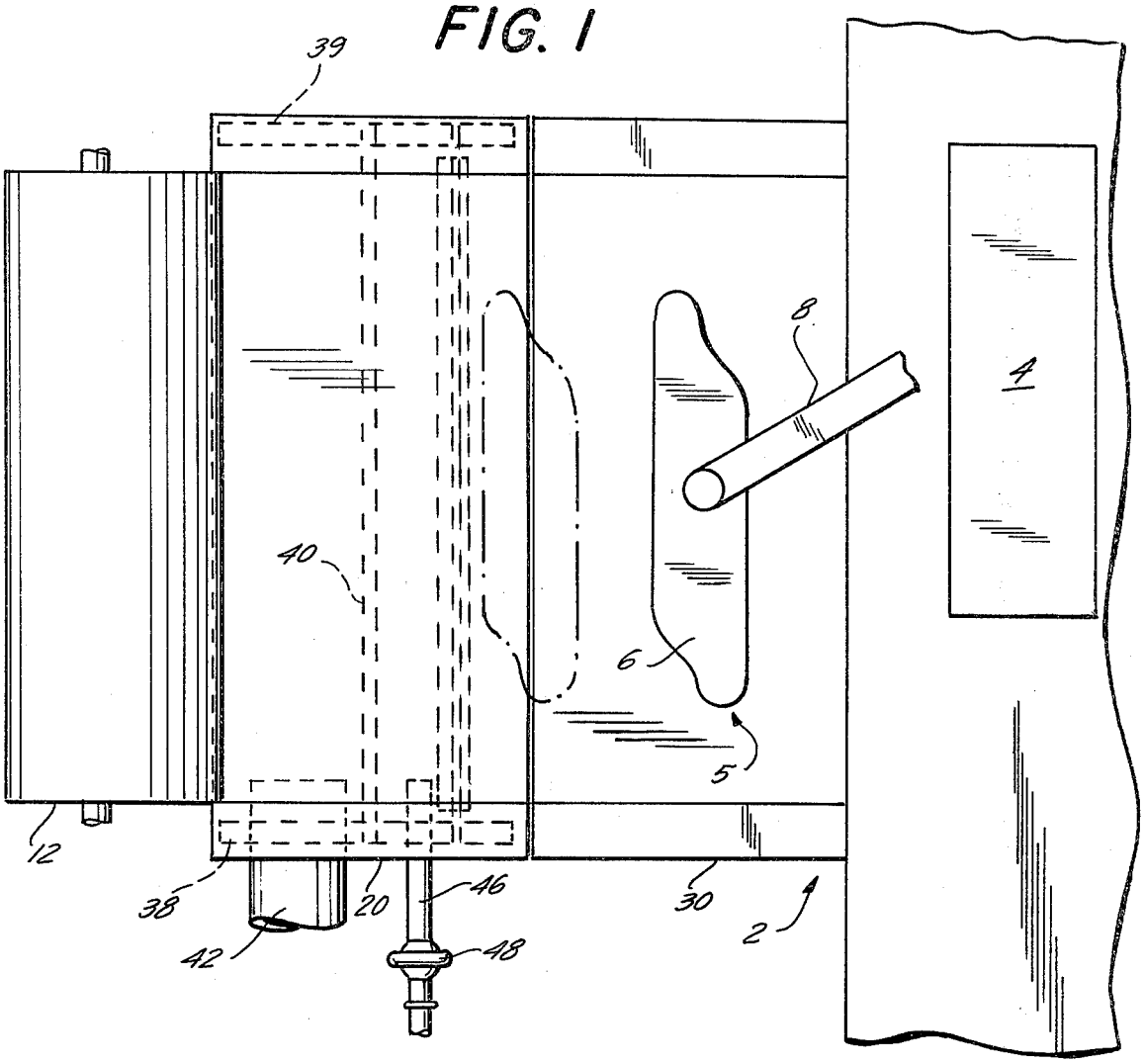
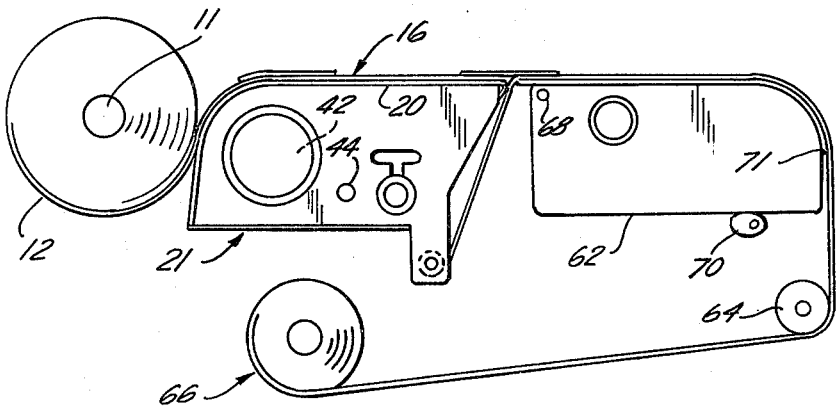
FIG. 2

FIG. 3
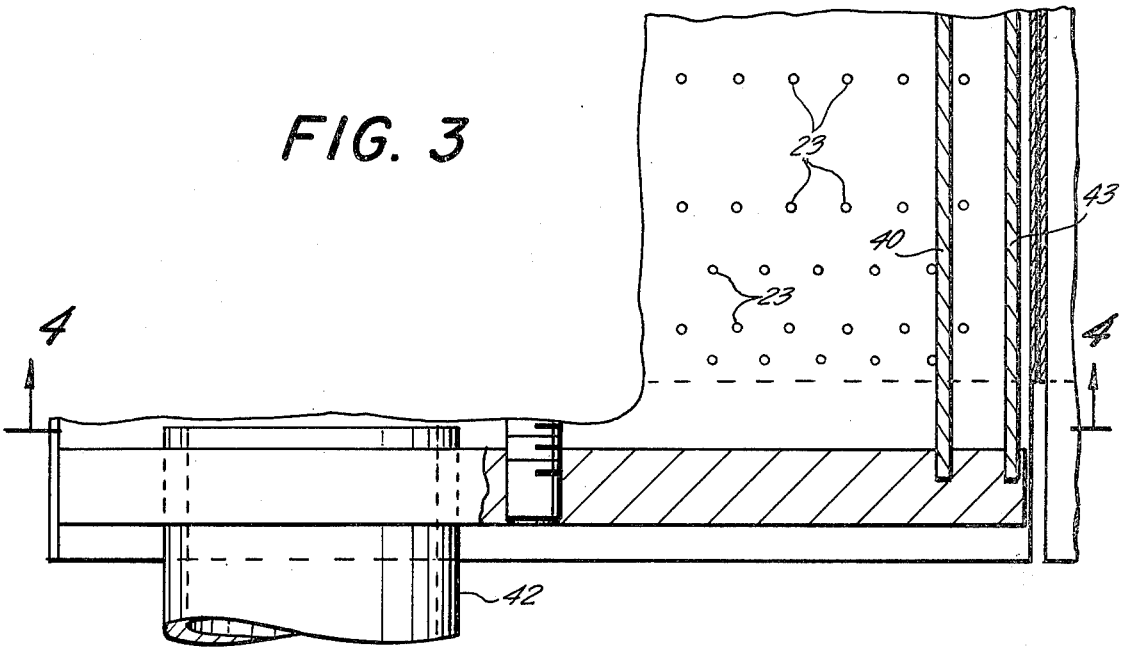
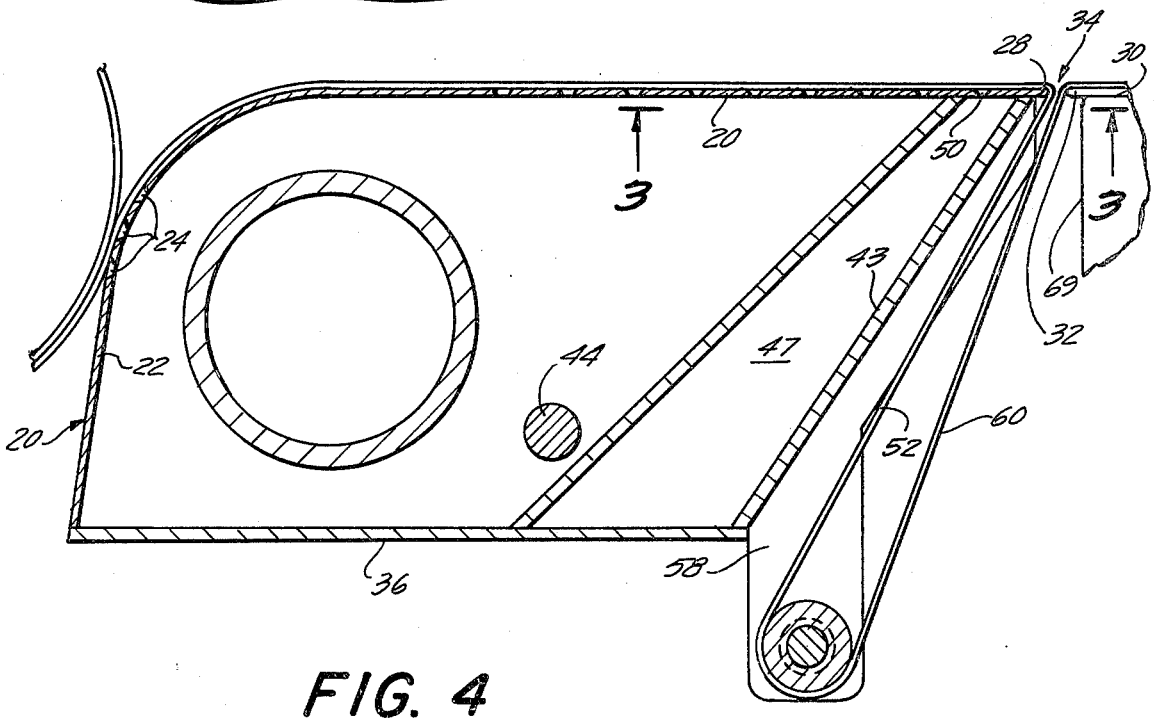
FIG. 4

METHOD AND APPARATUS FOR REMOVING CIGAR WRAPPERS FROM THE WEB OF A BOBBIN

This invention relates to providing wrappers for cigars, and more in particular to delivering cigar wrappers to a wrapping machine from a bobbin which comprises a roll formed by a continuous web or strip of sheet material upon one side of which the cigar wrappers have been placed individually and compressed between the layers of the sheet in the roll.

Cigar wrapping machines are well known in which cigars are wrapped automatically. The cigars and wrappers for them are picked up individually and delivered to the overroller unit in the wrapping machine. In the prior machines, a portion of a leaf from which a wrapper is to be formed is placed onto a cutting die which is part of the machine, and the wrapper is formed and then moved directly from the die to the wrapping zone. That wrapper-forming step requires the full time of an operator to place each tobacco leaf portion onto the die. It is also common practice to prepare the tobacco leaf portions at or near the time and place of use of the wrappers.

There has been a recent development of a "bobbin system" by which the cigar wrappers can be made independently of the time and place of use. The "bobbin system" comtemplated completely divorcing the cutting of the cigar wrappers from the cigar wrapping operation. With the "bobbin system" the cigar wrappers are removed from the dies and placed individually and spread out flat in alignment on the top surface of a continuous strip or web of sheet material. The web is wound into a tight roll or bobbin, so that each cigar wrapper is compressed tightly between the web surface upon which it was first placed and the coextensive surface of the next layer of the web in the roll. That traps the wrappers between the layers and holds them firmly. The complete bobbin can then be placed in a freezing room so that the entire roll is frozen, and it can then be shipped and/or stored at sub-freezing temperatures. The wrappers are then available in the more or less indefinite future by merely thawing the roll.

A standard type of cigar wrapping machine has a cutting die which surround a suction plate of the size and shape desired in the cigar wrapper. An operator places a portion of a tobacco leaf on the plate and it is held by suction and moved onto the exposed knife edge, and a roller passes over the leaf so as to effect the cutting of the leaf into a cigar wrapper. The suction is then cut off from the suction plate, and a transfer plate or carrier is moved by its transfer arms over the cigar wrapper and the cigar wrapper is lifted onto the bottom of the carrier by the action of its suction. The bobbin system contemplated that the wrappers would be presented individually to the vicinity of the transfer plate and each wrapper would be picked off by the transfer plate and moved to the rolling mechanism.

When using the bobbin system with a standard type of cigar wrapping machine, the machine can be provided with a bobbin unwinder and a rewinder, and there is a system for passing the web into the machine so that each wrapper is moved to the exact position where wrappers were cut by the die in the past. The transfer plate or carrier is then utilized in the same way as in the past to pick up the wrappers individually and deliver them to the overroller unit. The web or sheet then passes downwardly and to a rewinder which produces which produces a roll of the web alone. However, great difficulty has been encountered in providing for the satisfactory delivery of the wrappers to the carrier. The principal difficulty has been that at least some of the wrappers were adhered to the sheet material forming the web. Attempts to loosen those wrappers from the sheet material resulted in an unacceptable rate of damage to the wrappers. Hence, while the quality of the wrappers in the bobbin can be equal to or superior to those produced individually by operators at the wrapping machines, the bobbin system has not been successful because of the inability to perform the transfer of the wrappers from the sheet material.

It is an object of the present invention to insure that each of the wrappers is removed from the web and delivered to the transfer plate without damage to the wrapper and in a manner which is commercially feasible and adaptable to various conditions of operation and use.

In the drawings:

FIG. 1 is a partially schematic top-plan view of a machine constituting one embodiment of the invention;

FIG. 2 is a partially schematic side elevation of the machine of FIG. 1;

FIG. 3 is an enlarged view of the central portion of FIG. 2 and

FIG. 4 is a sectional view on the line 4—4 of FIG. 3.

Referring to FIG. 1 of the drawings, a cigar wrapping machine 2 is shown somewhat schematically, and has an overroller unit 4 which forms the wrapping zone, and a transfer plate or carrier 6 mounted upon a transfer arm assembly 8. Carrier 6 is moved between the position shown in the transfer zone 5, where it picks up each wrapper, and overroller unit 4 to which it discharges each wrapper. Cigars to be wrapped are supplied to unit 4 and removed when overwrapped by known means (not shown). A bobbin 12 is formed by a continuous web or sheet 18, and the wrappers 17, and is mounted in an unwinder (not shown) with the bobbin axis 11, positioned horizontally (see FIG. 2) below the horizontal level 16 of the transfer zone. The unwinder has a brake which restrains the unwinding of the bobbin so that web 18 is drawn from bobbin 12 under tension. The web then is drawn from bobbin 12 under tension upwardly and along the top surface of a sheet steel plate 20 having perforations 23 therein. Plate 20 forms the top wall of a suction box 21, and air is withdrawn through perforation 23 from beneath the moving web or sheet passing along the top surface of the plate so as to produce suction through the sheet. That permits the sheet to move in a controlled manner, and the suction holds the wrapper firmly against the top surface of the sheet.

As shown best in FIG. 4, plate 20 has a downwardly extending skirt portion 22 at the left which forms the left-hand end wall for suction box 21 and to which the web 18 passes while moving from the bobbin. Suction box 21 also has a bottom plate 36, a pair of end plates 38 and 39 (see also FIG. 1), and a plate 40 which extends between the end plates. A suction pipe 42 extends through end plate 38 through which air is withdrawn to maintain a sub-atmospheric condition within the suction box. Large perforations or holes 24 are provided in the plate at that zone so as to produce substantial suction through the web, and that insures that the wrappers will pass from the bobbin with the web. Perforations 26 in the upper portion of skirt 22 and the horizontal portion of the plate are small (see FIG. 3), but provide sufficient air flow to hold the wrapper's web against the top surface of the web as it moves along the plate.

The downstream edge 28 (FIG. 4) of the plate is formed into a straight knife edge which extends transversely of the movement of the web. There is a second plate 30 with its upstream edge 32 spaced from knife edge 28 so as to form a gap 34 therebetween. Plate 30 has its upper surface in exact alignment with the top surface of plate 20, and is perforated in the same manner as plate 20.

Extending between the right-hand (FIG. 4) edge of bottom plate 36 and plate 20 adjacent knife edge 28 is a plate 43. An air pressure chamber 47 is formed between plates 40 and 43, and the right-hand portions of plate 20, bottom plate 36 and side plates 38 and 39.

Air under pressure is supplied to chamber 47 through an air line 46 (FIG. 1) which has a control valve 48. A row of perforations 50 in plate 20 provides discharge jet openings from air chamber 47 from which air is directed against web 18, in the zone upstream from gap 34.

The path of web 18 extends from the top surface of plate 20 around knife edge 28 at a sharp angle with a web run 52 which extends to a roller 54. Roller 54 is rotatably mounted at its ends upon a pair of arm extensions 58 which are integral with side plates 38 and 39. After passing around roller 54, the web has a run 60 which extends upwardly and back through gap 34 around the upstream edge of sheet 30. Hence, the path of the web is through the gap and around a loop along the surface of roller 34 and back through the gap. Referring again to FIGS. 1 and 2, the web then passes along plate 30 and passes downwardly around the downstream portion of the plate to an idler roller 64 and is wound into a roll 66.

Suction box 62 is similar to suction box 21 with end plates and side bottom plates, but it has a vertical plate 69 adjacent gap 34 and its apron 71 is at its downstream end. Suction box 62 is mounted adjacent its upstream edge upon a pair of pivot bolts 68 extending through the side plates, and it rests at the right upon a cam 70. When carrier 6 is moving to and from the position shown in FIG. 2, suction box 62 is positioned as shown. However, when the carrier is in that position, cam 70 is then turned so as to lift the right-hand end of the suction box up a distance of the order of one-eighth inch to move the wrapper up to the carrier, and the suction to the suction box is simultaneously cut off. The carrier is provided with suction which picks up the wrapper, and cam 70 is turned back so that the suction box returns to its normal position, and the suction in the suction box is then turned on again. The carrier transfers the wrapper to the overroller, as discussed above.

Referring again to FIG. 4, web 18 is drawn then through the machine by the rewind unit so that it is under tension, and it is held against plates 20 and 30 by the tension. Therefore, runs 52 and 60 are maintained taut so that the web is drawn around knife edge 28 so that it turns down through gap 34 at a relatively sharp angle. As each wrapper is carried toward gap 34, the leading edge portions of the wrapper are held with the web parallel to the top surface of plate 20. Therefore, as the web moves around the knife edge 28, the leading edge portions of the wrapper tend to project across the gap. The jets of air from perforations 50 project upwardly against the web with some passing upwardly through the web and some being deflected toward gap 34. Hence, as a wrapper moves toward gap 34 with the leading edge portions approaching the gap, air is projected against the bottom surfaces of the wrappers. The sharp turn in the web acts to peel the wrappers from the downwardly moving web. The tendency to peel is benefited by the jets of air, and also by the upward movement of the web from run 60. That is, after the leading edge portions of a wrapper contact the web moving upwardly around edge 32, and the web provides support for the wrapper in the same horizontal plane as the trailing remainder of the wrapper. Gap 34 is of sufficient width to avoid undesirable friction between the web portions as they move downwardly and upwardly through the gap. The support for the wrapper continues as the main body of the wrapper moves across the gap, and the fact that the web is moving at the same rate on both sides of the gap avoids any tendency to interfere with the constant uniform movement of the wrapper.

As used herein, the term "knife edge" means an edge which causes the wrappers to tend to peel from the web. In the illustrative embodiment, the angle of deflection of the web is of the order of 60° to 65° and sheet 20 has a thickness of one-eighth inch with a rounded edge at gap 34. That edge projects beyond the side plates so as to permit the web to extend directly toward the periphery of roll 54.

It is understood that the illustrative embodiment may be changed and that other embodiments may be provided, all within the scope of the claims.

What is claimed is:

1. In apparatus for delivering cigar wrappers along a path from a bobbin to an overrolling zone in a cigar wrapping machine wherein said bobbin comprises a roll formed by a continuous web of sheet material and cigar wrappers positioned individually between the turns in the roll, the combination of, rigid means extending along a wrapper delivery path and presenting a first surface and a second surface which are separated by a gap defined by first and second parallel straight edges extending transversely of the direction of movement, roller means forming a loop path extending from said first edge to said second edge and positioned upon the opposite side of said gap from said path, said roller presenting a surface around which said web passes when moving from said first edge to said second edge, and means to draw said web continuously along said path on said first surface and around said first edge and along said loop path around said roller means and back to said second edge and along said second path, said first edge being effective to change the direction of movement of said web at a sufficiently sharp angle that each of the wrappers is peeled from the web and projects across said gap toward said second surface, whereby each of said wrappers passes from its position along said first surface across said gap to a position above said second surface where it rests upon a portion of said web which is moving away from said gap.

2. Apparatus as described in claim 1 wherein said web is of a spun polyester material which is porous, and means adjacent said first edge to direct a jet of air from said first surface toward said web adjacent said gap thereby to promote the projecting of the leading edge portion of each wrapper along said path.

3. Apparatus as described in either of claims 1 or 2 and which includes suction means holding said wrappers against said web.

4. Apparatus is described in claim 1 wherein said first means comprises a metal plate having perforations therein and which forms one wall of a suction box, and wherein said jet means comprises an air chamber with jet openings and is positioned adjacent to said suction box.

5. Apparatus as described in claim 4 wherein the width of said gap is such as to provide a free space between the portion of said web moving around said first edge and the portion of said web moving in the opposite direction through said gap.

6. In apparatus for delivering cigar wrappers along a path from a bobbin to an overrolling zone in a cigar wrapping machine wherein said bobbin comprises a roll formed by a continuous web of sheet material and cigar wrappers positioned individually between the turns in the roll, the combination of, first and second plates which form said path which extends downstream along a first surface formed by said first plate and thence along a second surface formed by said second plate with a gap separating said plates and extending transversely of said path, means forming a knife edge at said gap projecting from said first surface, means positioned upon the opposite side of said knife edge from said path and providing a third surface around which the web passes as it moves from said knife edge and thence back toward said gap, whereby said web passes along said first surface and then is drawn around said knife edge and thereafter around said third surface and back through said gap and along said second surface, and whereby said cigar wrappers move across said gap from said first plate to said second plate, and means to hold said web taut as it passes along said path.

7. In apparatus for delivering cigar wrappers from a bobbin to an overrolling zone in a cigar wrapping machine wherein said bobbin comprises a roll formed by a continuous web of sheet material and cigar wrappers positioned individually between the turns in the roll, the combination of, first means which presents a first surface, suction means to draw air through said web to hold said wrappers against said web as it moves along said first surface, second means which presents a second surface in substantial alignment with said first surface and is separated therefrom by a transverse gap, means forming a knife edge between said first surface and said gap, a roller positioned upon the opposite side of said gap from said surfaces and parallel to said knife edge whereby said web can be drawn along path around said knife edge through said gap at a substantial angle from said first surface and thence around said roll and back through said gap to said second surface, jet means to discharge air through said web toward each of said wrappers in the vicinity of said knife edge, whereby the leading portion of each wrapper is peeled away from said web by the combined action of the passage of said web around said knife edge and air from said jet means, and whereby each wrapper is removed from said web and is projected across said gap onto the portion of said web which is moving from said gap along said second surface path.

8. Apparatus as described in claim 7 wherein said first means is the top wall of an air box which is a component of said suction means.

9. Apparatus as described in claim 8 wherein each of said first means and said second means includes a horizontal perforated plate, and which include means to discharge air upwardly through said web as it moves to said knife edge.

10. In a method for delivering cigar wrappers to a wrapping machine from a bobbin which has been formed by placing a continuous series of individual wrappers upon a continuous web of sheet material and rolling the sheet material into a tight roll, the steps of, passing the web away from the bobbin along a path with the side of the web upon which the cigar wrappers are placed being exposed, drawing the leading end of the web along a path, drawing air through the web from said side thereof so as to insure that the wrappers are held firmly upon the web surface, said path extending to a gap and around a knife edge at a substantial angle whereby the web moves away from the general plane of said path and through said gap and the leading edge portions of said wrappers are projected along said plane past said gap, drawing said web from said gap in the direction and at the rate at which said wrappers are being moved past said gap whereby each wrapper is released from said web at said gap and is carried away from said gap by the web portion moving from said gap.

11. In a method for removing cigar wrappers from a bobbin formed by a continuous roll of a porous sheet material in which the cigar wrappers are packed, the steps of, passing the sheet continuously along a perforated surface formed by the exposed surface of a perforated plate which has a transverse knife edge, producing a partial vacuum condition upon the opposite side of said plate from said surface so as to draw air from the surface of said sheet toward said perforated surface, passing said sheet around said knife edge so as to peel the wrappers from said sheet, passing said sheet around a roll positioned upon the opposite side of said edge from said surface and thence back to a surface which is in substantial alignment with the first-named surface.

12. In a method for delivering cigar wrappers along a path from a bobbin to an overrolling unit in a cigar wrapping machine wherein said bobbin comprises a continuous web of sheet material upon one side of which the wrappers have been placed individually and compressed between the layers of the web in the roll, the steps of, moving the web from the bobbin along a predetermined path which passes over first and second surfaces with the wrappers moving in a predetermined plane and said surfaces having coextensive edges upon the opposite sides of a gap and in substantial alignment adjacent said gap with the upstream of said edges being a knife edge, moving said web around said edge through said gap at a sharp angle so as to tend to peel each wrapper from the web with the wrapper projecting above the gap adjacent said plane and whereby the web moves away from said plane, passing said web around a surface which reverses its direction of movement generally back toward said gap and thence through said gap around said edge of the other of said surfaces and along said other of said surfaces, whereby a wrapper which is peeled from said web and projects over said gap moves onto the portion of said web moving around said second of said edges and there is uninterrupted movement of the wrapper across said gap.

13. Apparatus as described in either of claims 8 or 9 which includes means supporting said bobbin with its axis positioned below the level of said path and with said web moving upwardly from said bobbin to said path, and means which draws said web from said path and winds said web into a roll.

* * * * *